US008915089B2

(12) United States Patent
Myers et al.

(10) Patent No.: US 8,915,089 B2
(45) Date of Patent: Dec. 23, 2014

(54) SYSTEM AND METHOD FOR DETECTING AND CONTROLLING FLASHBACK AND FLAME HOLDING WITHIN A COMBUSTOR

(75) Inventors: Geoffrey David Myers, Simpsonville, SC (US); Timothy Joseph Rehg, Simpsonville, SC (US); Timothy Andrew Healy, Simpsonville, SC (US); Anthony Wayne Krull, Anderson, SC (US)

(73) Assignee: General Electric Company, Schenectady, NY (US)

( * ) Notice: Subject to any disclaimer, the term of this patent is extended or adjusted under 35 U.S.C. 154(b) by 1634 days.

(21) Appl. No.: 12/692,942

(22) Filed: Jan. 25, 2010

(65) Prior Publication Data

US 2014/0075953 A1 Mar. 20, 2014

(51) Int. Cl.

| | |
|---|---|
| ***F02G 3/00*** | (2006.01) |
| ***F02C 3/00*** | (2006.01) |
| ***F02C 6/00*** | (2006.01) |
| ***F02C 1/00*** | (2006.01) |
| ***F02C 9/00*** | (2006.01) |
| ***F23N 1/02*** | (2006.01) |
| ***F23D 5/12*** | (2006.01) |
| ***F23N 5/08*** | (2006.01) |
| ***G01J 5/02*** | (2006.01) |
| ***F23N 5/04*** | (2006.01) |
| ***F23N 5/24*** | (2006.01) |
| ***F23D 14/82*** | (2006.01) |
| ***F23R 3/28*** | (2006.01) |

(52) U.S. Cl.

CPC *F23N 5/08* (2013.01); *F23N 5/082* (2013.01); *F23N 2041/20* (2013.01); *F23D 2209/10* (2013.01); *F23N 5/04* (2013.01); *F23N 5/242* (2013.01); *F23D 14/82* (2013.01); *F23R 3/286* (2013.01); *F23D 2208/10* (2013.01); *F23R 2900/00002* (2013.01); *F23D 2900/00008* (2013.01)

USPC ..... 60/779; 60/39.091; 60/39.01; 60/803; 60/773; 60/772; 431/12; 431/13; 431/79; 250/339.15; 250/339.08

(58) Field of Classification Search

CPC ..... F02C 9/28; F02C 9/46; F02C 7/262; F05B 2270/301; F23N 5/242; F23N 1/022; F23N 5/003; F23N 2035/16; F01D 21/045; F01D 21/06; G08B 17/12; G08B 25/002; G01J 5/0014

USPC ..... 60/779, 39.091, 39.01, 803, 773, 772; 431/12, 13, 79; 250/339.15, 339.08

See application file for complete search history.

(56) References Cited

U.S. PATENT DOCUMENTS 5,857,320 A * 1/1999 Amos et al. ..... 60/776
5,961,314 A 10/1999 Myhre et al.

(Continued)

OTHER PUBLICATIONS

U.S. Appl. No. 12/249,158, filed Oct. 10, 2008.

(Continued)

*Primary Examiner* — Phutthiwat Wongwian
*Assistant Examiner* — Jared W Pike
(74) *Attorney, Agent, or Firm* — Dority & Manning, P.A.

(57) ABSTRACT

A system is provided for detecting and controlling flashback and flame holding in a combustor of a gas turbine. The system includes at least one flame indicator disposed in a combustor and at least one detector disposed downstream from the flame indicator. The flame indicator may be configured to produce light when exposed to a flame and the detector may be configured to detect the light produced by the flame indicator.

12 Claims, 5 Drawing Sheets

(56) References Cited

U.S. PATENT DOCUMENTS

| | | | | |
|---|---|---|---|---|
| 6,429,020 | B1 | 8/2002 | Thornton et al. | |
| 7,019,305 | B2 | 3/2006 | Eversmann | |
| 7,281,382 | B2 * | 10/2007 | Plimpton et al. | 60/779 |
| 7,334,413 | B2 * | 2/2008 | Myhre | 60/803 |
| 7,484,369 | B2 * | 2/2009 | Myhre | 60/803 |
| 2007/0119147 | A1 * | 5/2007 | Cornwell et al. | 60/39.281 |
| 2008/0016877 | A1 | 1/2008 | Miller et al. | |
| 2008/0083228 | A1 * | 4/2008 | Myhre | 60/773 |

OTHER PUBLICATIONS

U.S. Appl. No. 12/256,901, filed Oct. 23, 2008.
U.S. Appl. No. 12/354,010, filed Jan. 15, 2009.
U.S. Appl. No. 12/395,525, filed Feb. 27, 2009.
Jimmy D. Thorton, "Flashback Detection Sensor for Hydrogen Augmented Natural Gas Combustion", pp. 108, GT 2007-27865, May 14, 2007 U.S. Department of Energy, Morgantown, West Virginia.

* cited by examiner

SYSTEM AND METHOD FOR DETECTING AND CONTROLLING FLASHBACK AND FLAME HOLDING WITHIN A COMBUSTOR

FIELD OF THE INVENTION

The present subject matter relates generally to gas turbines and particularly to combustors disposed in gas turbines. More particularly, the present subject matter relates to a system and method for detecting and controlling flashback and flame holding within a combustor.

BACKGROUND OF THE INVENTION

In order to reduce the formation of air polluting emissions, such as NOx, combustors in a gas turbine often include a lean-premixed combustion system, wherein fuel and air are mixed in a plurality of premixed fuel nozzle assemblies disposed upstream of a combustion chamber in the combustor. However, the use of a lean-premixed combustion system also increases the propensity for flashback events, which occur when the flame within the combustion chamber flashes upstream into the premixing zone of the fuel nozzle assembly. The likelihood of flashback events occurring may be increased further when highly reactive fuels are used to fuel a gas turbine, such as hydrogen augmented fuels and fuels derived from liquefied natural gas. These flashback events often lead to flame holding, wherein the flame "holds" or remains supported within the fuel nozzle assembly. Flame holding can result in significant damage to the fuel nozzle assembly, as increased temperatures within the fuel nozzle exceed the design temperatures of the nozzle materials. Additionally, prolonged flame holding may cause the nozzle material to melt away. This can lead to serious damage to the turbine blades, as melted portions of the fuel nozzle assembly flow through a combustor and into the turbine section of a gas turbine.

In order to prevent such damage, various devices have been proposed to detect flashback and flame holding in a fuel nozzle assembly. For example, some detection devices use thermocouples to detect temperature changes. However, thermocouples only provide flashback and flame holding detection at single points within a fuel nozzle assembly. Accordingly, it is quite complex and costly to place thermocouples in every location within a fuel nozzle assembly where flame holding may occur. Other devices are known that utilize an electric field to detect flames within the fuel nozzle assembly. However, this requires electrical wiring running to each nozzle in order to achieve nozzle-level detection. Moreover, it has been found that there are both cost and reliability issues associated with the use of electric fields to detect flames.

Accordingly, there is a need for a system and method for detecting and controlling flashback and flame holding within a combustor that is reliable, relatively simple and effective without being cost-prohibitive.

BRIEF DESCRIPTION OF THE INVENTION

Aspects and advantages of the invention will be set forth in part in the following description, or may be obvious from the description, or may be learned through practice of the invention.

In one aspect, the present subject matter provides a unique system for detecting and controlling flashback and flame holding in a combustor of a gas turbine. The system includes at least one flame indicator disposed in a combustor and at least one detector disposed downstream from the flame indicator. The flame indicator may be configured to produce light when exposed to a flame and the detector may be configured to detect the light produced by the flame indicator.

In another aspect, the present subject matter provides a gas turbine capable of detecting and controlling flashback and flame holding. The gas turbine may include a compressor section for pressurizing air and a combustor section configured to receive the pressurized air, mix the air with fuel to form an air/fuel mixture and combust the air/fuel mixture. A turbine section may be disposed downstream of the combustor section and can be configured to receive hot gases of combustion flowing from the combustor section. Additionally, the gas turbine may include the system discussed above and described in greater detail herein.

In a further aspect, the present subject matter provides a method for detecting and controlling flashback and flame holding within a combustor of a gas turbine. The method includes the steps of indicating the existence of flame holding in a combustor by producing light of a specific color, detecting the light produced, notifying a gas turbine control system of the detected light and determining whether flame holding exists within the combustor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWING

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
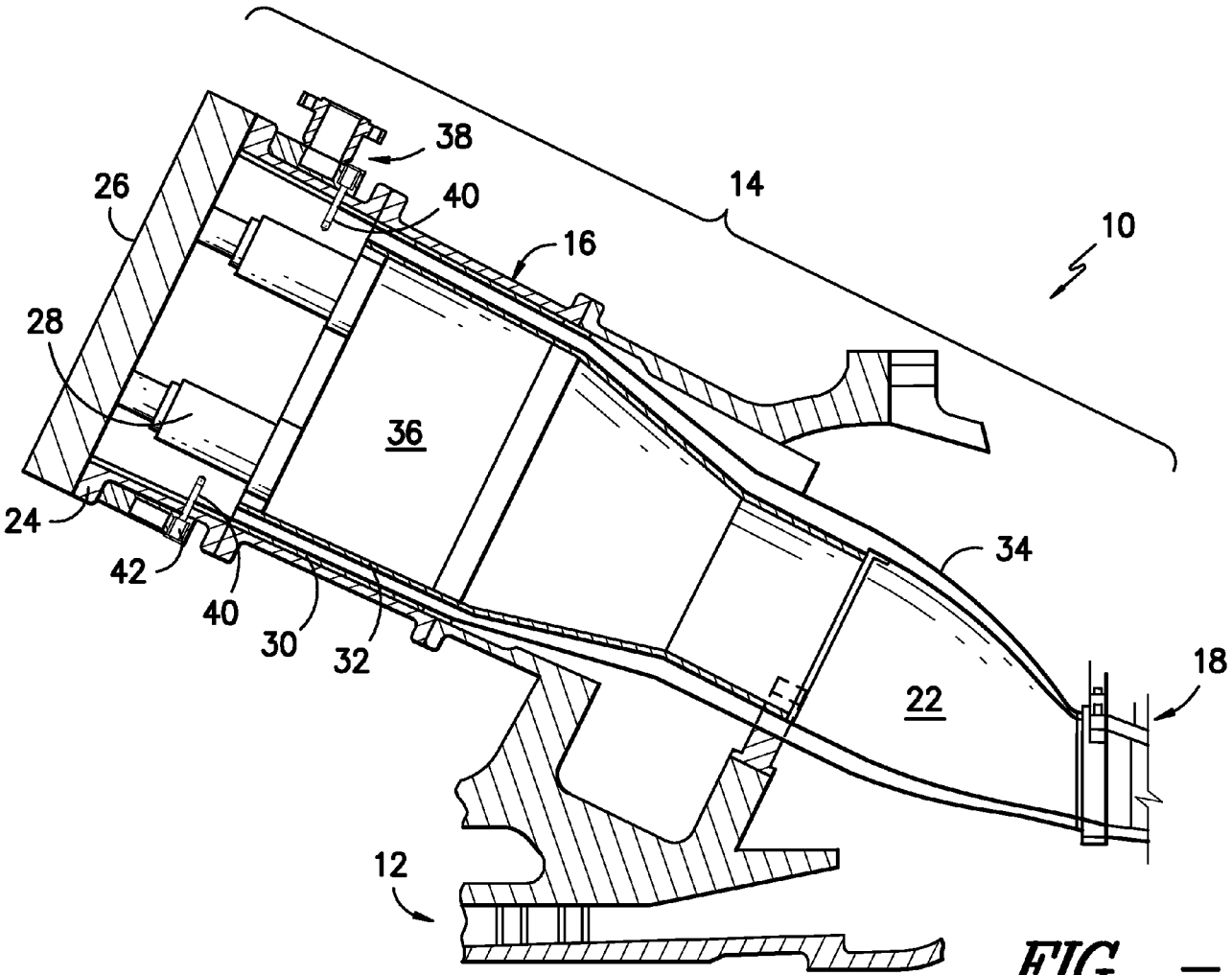
FIG. 1 illustrates a cross-sectional view of several portions of a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention covers such modifications and variations as come within the scope of the appended claims and their equivalents.

Referring to FIG. 1, a simplified drawing of several portions of a gas turbine 10 is illustrated. The gas turbine 10 comprises a compressor section 12 for pressurizing air flowing into the turbine 10. Pressurized air discharged from the compressor section 12 flows into the combustor section 14, which is generally characterized by a plurality of combustors 16 disposed around an annular array about the axis of the engine (only one of which is illustrated in FIG. 1). The air entering the combustor section 14 is mixed with fuel and combusted. Hot gases of combustion flow from each combustor 16 to a turbine section 18 to drive the gas turbine 10 and generate power.

Still referring to FIG. 1, each combustor 16 in the gas turbine 10 may include a lean-premixed combustion system for mixing and combusting an air/fuel mixture and a transition piece 22 for flowing hot gases of combustion to the turbine section 18. As shown in FIG. 1, the lean-premixed combustion system of each combustor 16 includes a combustion casing 24, an end cover 26, a plurality of premix fuel nozzle assemblies 28, a flow sleeve 30, and a combustor liner 32 disposed within the flow sleeve 30. During operation, pressurized air exiting the compressor section 12 flows into each combustor 16 through the flow sleeve 30 and the impingent sleeve 34 of the transition piece 22, where it is swirled and mixed with fuel injected into each fuel nozzle assembly 28. The air/fuel mixture exiting each fuel nozzle assembly 28 flows into the combustion chamber 36 or reaction zone, defined by the combustor liner 32, where it is combusted. As indicated above, the hot gases of combustion then flow through a transition piece 22 to the turbine section 18 in order to drive the gas turbine 10 and generate electricity. It should be readily appreciated, however, that a combustor 16 need not be configured as described above and illustrated herein and may generally have any configuration that permits pressurized air to be mixed with fuel, combusted and transferred to a turbine section 18 of a gas turbine 10.

Each combustor 16 may also include a quaternary fuel system 38 that injects a small amount of fuel into the pressurized airflow upstream of the premixed fuel nozzle assemblies 28 in order to control the combustion dynamics of the lean-premixed combustion system. The quaternary fuel system 38 may include a plurality of quaternary pegs 40 disposed circumferentially around the inside of the combustion casing 24. Each quaternary peg 40 may be supplied fuel by a quaternary fuel manifold 42, defining a fuel circuit, disposed around the outer circumference of the combustion casing 24.

Figure 2:
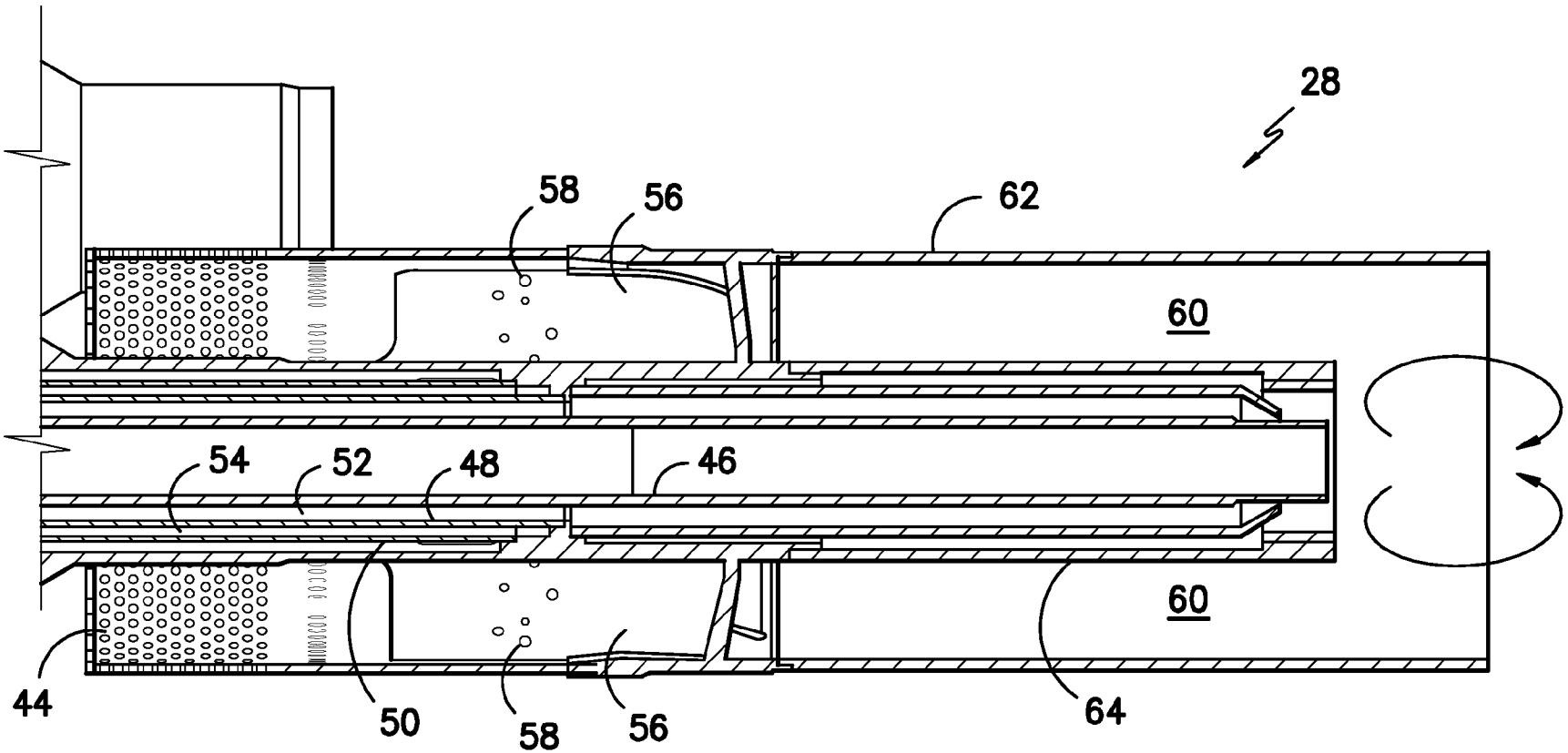
FIG. 2 illustrates a cross-sectional view of a premixed fuel nozzle assembly that may be installed in a gas turbine.

Referring to FIG. 2, a premixed fuel nozzle assembly 28 is illustrated. As shown, the fuel nozzle assembly 28 may include an inlet flow conditioner 44 to improve the air flow velocity distribution through the fuel nozzle assembly 28. The fuel nozzle assembly 28 may also include a central tube 46 and concentric tubes 48, 50 defining discrete annular premix fuel passages 52, 54 respectively between tubes 46 and 48 and tubes 48 and 50. The central tube 46 may be configured to supply diffusion gas to the combustion chamber 36 of the combustor 16 (FIG. 1). Air flowing from the inlet flow conditioner 44 may be directed to a plurality of air swirler vanes 56 to impart a swirling pattern to the air and facilitate the mixing of the air with the fuel. The air swirler vanes 56 may include fuel injection ports or holes 58 that inject fuel flowing from the premix fuel passages 52, 54 into the air stream. The air and fuel may then flows into a premixing zone or premixing annulus 60, defined by an outer burner tube 62 and an inner burner tube 64, wherein the air and fuel are mixed prior to entering the combustion chamber 36. However, it should be readily appreciated that a fuel nozzle assembly 28 may be configured or arranged in any manner generally known to those of ordinary skill and need not be configured as described or illustrated herein.

Figure 3:
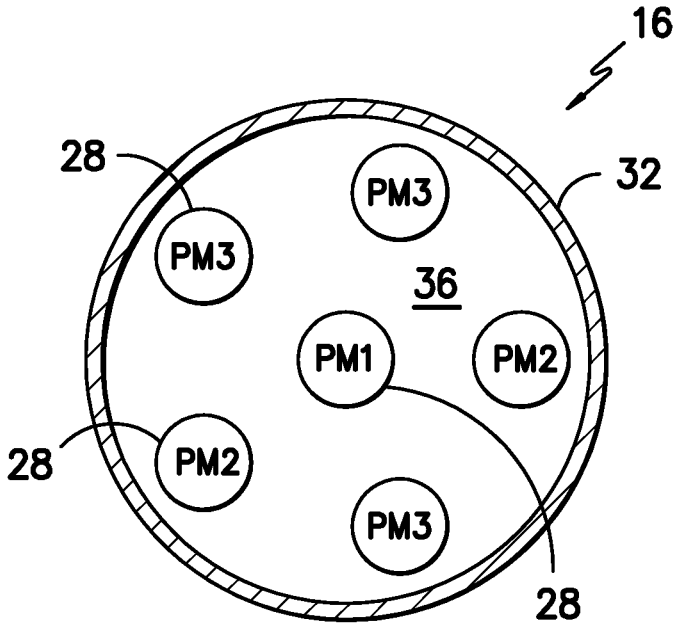
FIG. 3 illustrates a simplified cross-sectional view of a combustion chamber looking back at the exit of the premixed fuel nozzle assemblies and identifying the fuel circuit that supply each fuel nozzle assembly.

It should also be appreciated that each combustor 16 in a gas turbine 10 may include any number of premixed fuel nozzle assemblies 28. For example, FIG. 3 illustrates a simplified cross-sectional view of a combustion chamber 36, defined by the combustor liner 32, looking back at the exit of a plurality of fuel nozzle assemblies 28 in a combustor 16. In the illustrated embodiment, each combustor 16 includes six fuel nozzle assemblies 28. Fuel may be supplied to each fuel nozzle assembly 28 by one or more premixed fuel manifolds (not illustrated). In one embodiment, three premixed fuel manifolds may be utilized to define three separate fuel circuits PM1, PM2, and PM3. As shown in FIG. 3, the PM fuel circuit may supply fuel to the center fuel nozzle assembly 28, the PM2 fuel circuit may supply fuel to two of the outer fuel nozzle assemblies 28, and the PM3 fuel circuit may supply fuel to remaining three outer fuel nozzle assemblies 28. As indicated above, the quaternary fuel system 38 may be supplied by a separate fuel circuit defined by the quaternary fuel manifold 42 (FIG. 1).

As is generally known, damage may occur to a premixed fuel nozzle assembly 28 or to other components of a gas turbine 10 when the flame within the combustion chamber 36 flashes back into the fuel nozzle assembly 28. Additionally, if the air/fuel mixture within the premixing annulus 60 is sufficient to support the flame, the flame can "hold" within the fuel nozzle assembly 28. This can result in significant damage and costly downtime. However, it should be appreciated that, although flashback and flame holding are primarily discussed herein with respect to fuel nozzle assemblies 28, these conditions may occur in other locations within a combustor 16. For example, flashback and flame holding may occur adjacent to or at the quaternary pegs 40 of the quaternary fuel system 38. Flashback and flame holding may also occur in or adjacent to a secondary combustion system (not illustrated) of a gas turbine 10, such as a late lean injection system or a lean direct injection system.

Figure 4:
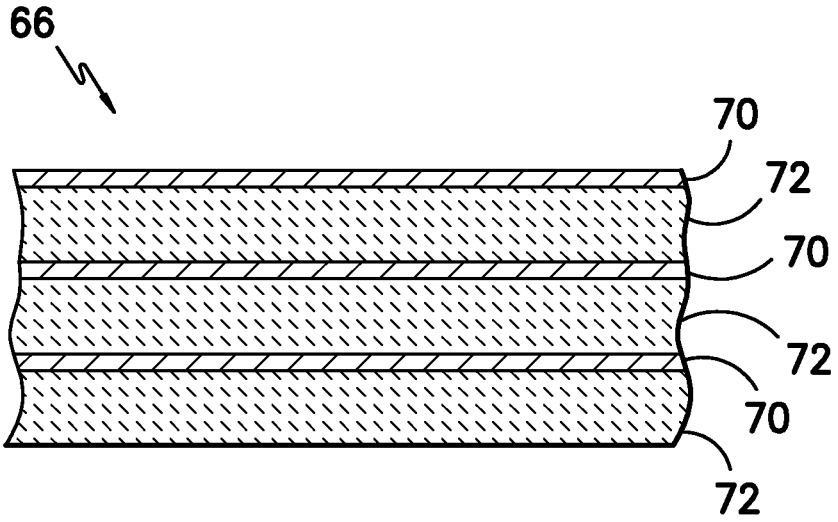
FIG. 4 illustrates a cross-sectional view of an embodiment of a flame indicator in accordance with an aspect of the present subject matter.
Figure 5:
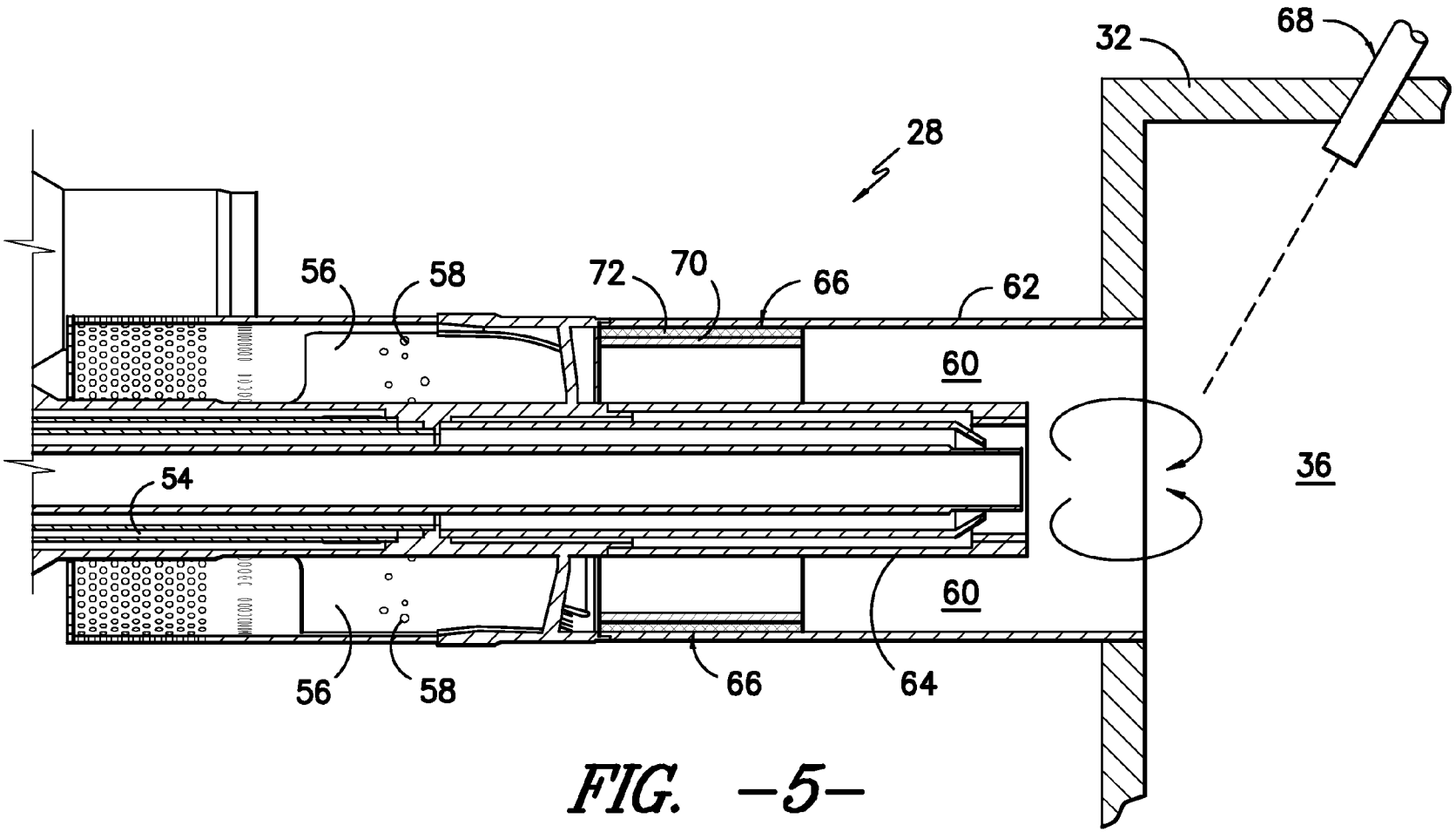
FIG. 5 illustrates a cross-sectional view of an embodiment of the presently disclosed system with a flame indicator installed in a premixed fuel nozzle assembly in accordance with an aspect of the present subject matter.
Figure 6:
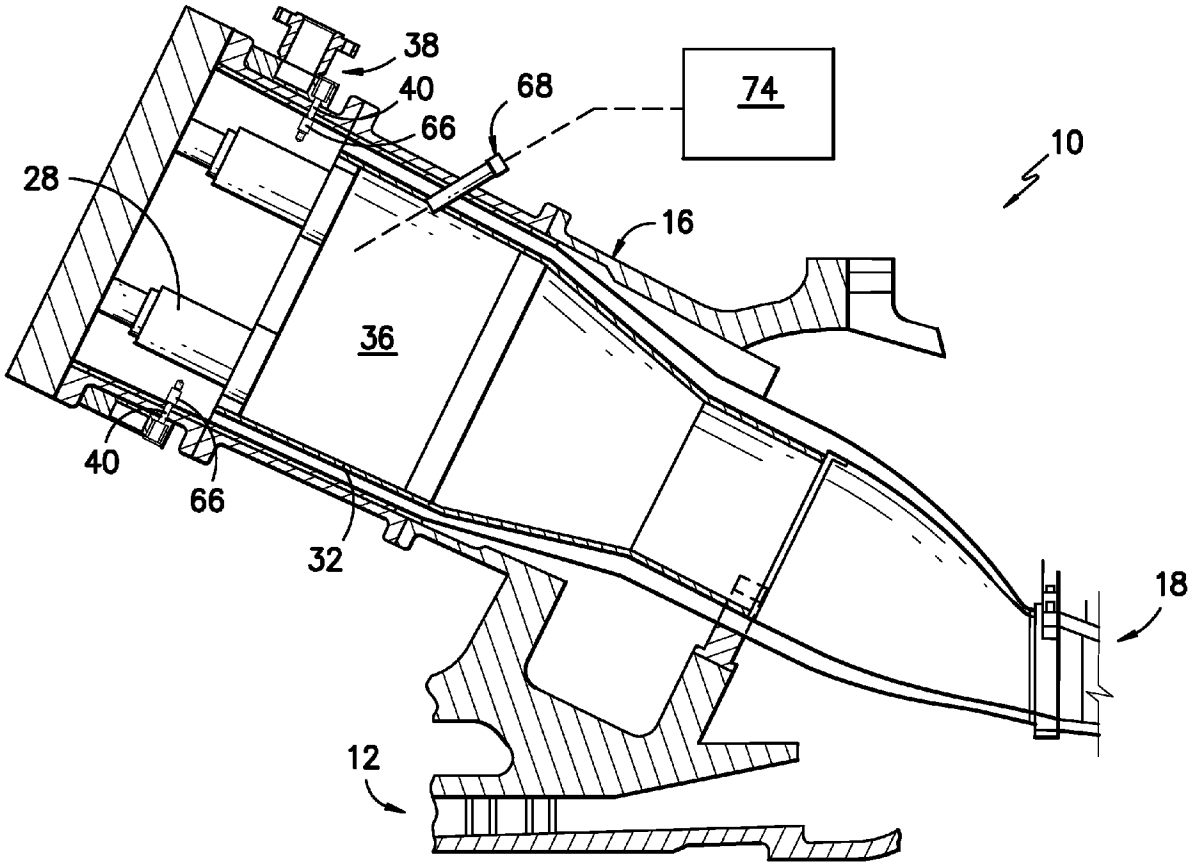
FIG. 6 illustrates a cross-sectional view of an embodiment of a detector of the presently disclosed system installed within a portion of a gas turbine in accordance with an aspect of the present subject matter.

In accordance with an aspect of the present subject matter, FIGS. 4-6 illustrate embodiments of a system for detecting and controlling flashback and flame holding within a combustor. The system includes at least one flame indicator 66 and at least one detector 68. The flame indicator 66 may be disposed within a combustor 16 and may be configured to produce light when exposed to a flame. The detector 68 may be disposed downstream from the flame indicator 66 and may be configured to detect the light produced by the flame indicator 66.

Generally, the flame indicator 66 of the present subject matter may have any configuration that allows the indicator 66 to produces light when exposed to a flame. As such, the flame indicator 66 may be used to signify the existence of flame holding within a combustor 16 by producing a detectable, signature light when in the presence of a flame. In one embodiment, illustrated in FIG. 4, the flame indicator 66 comprises a multi-layer assembly of alternating protective layers 70 and witness layers 72. Each protective layer 70 may be configured to ablate in the presence of a flame so as to reveal the underlying witness layer 72. Once revealed and exposed to a flame, the underlying witness layer 72 may be configured to produce light of a specific color. It should be appreciated, however, that the flame indicator 66 may comprise any number layers. For example, as shown in FIG. 5, the flame indicator 66 may only comprise a single protective layer 70 and a single witness layer 72.

As indicated above, the protective layer(s) 70 of the present subject matter may be configured to ablate in the presence of a flame. For example, the protective layer(s) 70 may be configured to rapidly melt or oxidize away when exposed to a high temperature flame in order to reveal the witness layer underneath 72. Thus, the protective layer(s) 70 may be composed of any material that is capable of withstanding normal operating temperatures within the areas of a combustor 16 not designed for high temperatures (e.g. the premixing annulus 60 or the area adjacent to the quaternary fuel pegs 40), but ablates when exposed to higher temperatures due to flashback and flame holding. In one embodiment, the protective layer(s) 70 may be composed of a metal with a relatively low melting point (e.g. 304 stainless steel, 316 stainless steel, or aluminum) or a high temperature paint (e.g. alumina-based high temperature paint) that will rapidly melt or oxidize in the presence of flame.

Additionally, each protective layer 70 may be applied to a witness layer 72 by any suitable means so that the protective layer 70 provides a protective coating for each witness layer 72. For example, the protective layer(s) 70 may be painted or plated (e.g. by electroplating) on to the witness layer 72. Moreover, as it may be desirable for each protective layer 70 to rapidly ablate away in the presence of a flame, the protective layer(s) 70 may be applied as a relatively thin coating. For example, in one embodiment, the thickness of the protective layer(s) 70 may be less than 0.005 cm, such as less than 0.003 cm. However, it should be appreciated that the desired thickness of the protective layer(s) 70 may vary significantly depending on numerous factors including, but not limited to, the material used to make the witness layer and the operating temperatures of a particular gas turbine 10.

Once a protective layer 70 has ablated away so as to expose an underlying witness layer 72 to a flame, the witness layer(s) 72 of the present subject matter may be generally configured to produce light of a specific color. Thus, the witness layer(s) 72 may be composed of any metal, metal salt, or other compound that produces light of a particular wavelength range via chemiluminescence when exposed to a flame. For example, the witness layer 72 may include sodium such that a yellow-colored light is produced when the layer is exposed to a flame. Alternatively, the witness layer 72 may include cobalt to produce a blue-colored light. It should be readily appreciated that various combinations of metals, metal salts, or compounds may be chosen such that a witness layer 72 can produce light of any desired color when exposed to a flame. Additionally, the thickness of each witness layer 72 may vary depending on the desired duration of the detection event. For instance, the witness layer 72 may have a certain thickness so as to produce several minutes of light when exposed to a flame at maximum operating pressures and temperatures within a combustor 16.

The layered flame indicator 66, discussed above, may be generally disposed at any location within a combustor 16. Particularly, it may be desirable for a flame indicator 66 to be disposed at any location within a combustor 16 that may be subject to flashback and flame holding conditions. Accordingly, it should be appreciated that the system of the present subject matter may comprise a plurality of flame indicators 66 placed at various locations within a combustor 16. For example, a flame indicator 66 may be disposed in every premixed fuel nozzle assembly 28 within a gas turbine 10, one of which is illustrated in FIG. 5. Thus, referring to the combustor arrangement illustrated in FIG. 3, six flame indicators 66 may be disposed in every combustor 16 of a gas turbine 10. As such, when there is an upset in the fuel flow, a disturbance in the airflow, a slug of combustible liquids, or some other event that causes the flame within the combustion chamber 36 to flashback and flame hold within a fuel nozzle assembly 28, the thin protective layer 70 of the flame indicator 66 can melt away to expose the witness layer 72, which can immediately produce a signature colored light.

As shown in FIG. 5, the flame indicator 66 of the present subject matter may be installed in a fuel nozzle assembly 28 as a ring around the circumference of the inner diameter of the outer burner tube 62 so as to indicate the presence of a flame within the premixing annulus 60. A detector 68 may also be disposed downstream of the flame indicator 66, which will be discussed in greater detail below. The flame indicator 66 may be secured within the fuel nozzle assembly 28 by any means generally known to those of ordinary skill in the art. For example, the flame indicator 66 may be attached by welding or brazing to a surface of the premixing annulus 60. Additionally, it should be appreciated that a flame indicator 66 may be disposed at any location within a fuel nozzle assembly 28 and that more than one flame indicator 66 may be installed in each fuel nozzle assembly 28. For example, a flame indicator 66 may be disposed around the circumference of the outer diameter of the inner burner tube 64 and/or be installed adjacent to the fuel injector ports 58 on the air swirler vanes 56. Moreover, it should be appreciated that the flame indicator 66 of the present subject matter need not be ring-shaped, but may generally have any shape so as to allow the indicator 66 to be installed at a desired location.

Additionally, as shown in FIG. 6, one or more flame indicators 66 may also be positioned on or adjacent to the various components of the quaternary fuel system 38. For instance, flame indicators 66 may be disposed on the flowpath surface of the quaternary fuel system 38, on the quaternary peg 40, or on fuel vanes (not illustrated) immediately downstream of the quaternary fuel system 38 to indicate the presence of flashback and flame holding.

As previously indicated, the system of the present subject matter also includes at least one detector 68 disposed downstream from the flame indicator(s) 66 that may be configured to detect the light produced by the indicator(s) 66. As shown in FIGS. 5 and 6, the detector 68 may be mounted in the combustor liner 32 downstream of the premixed fuel nozzle assemblies 28 such that the entire combustion chamber 36, and more particularly the exit of each fuel nozzle assembly 28, is within the detector's field of view. Thus, any light produced by a flame indicator 66 positioned upstream may be detected by the detector 68. However, it should be appreciated that the detector 68 may be placed at any location downstream of a flame indicator 66 and need not be positioned or arranged as illustrated in FIGS. 5 and 6. Moreover, the detector 68 may generally comprise any device or apparatus capable of sensing or detecting light produced by a flame indicator(s) 66. For example, the detector 68 may comprise an optical detector with a band pass filter, a spectrometer, a camera, an ultraviolet flame detector an infrared detector, or any other suitable light detecting device known to those of ordinary skill in the art.

In one embodiment, illustrated in FIG. 6, the detector 68 may be in communication with a turbine control system 74 configured to determine whether flame holding exists within a combustor 16. For example, each combustor 16 in a gas turbine 10 may include a plurality of flame indicators 66 and at least one detector 68. When the detector 68 within a particular combustor 16 detects light produced by one of the flame indicators 66, it may be configured to transmit a signal to the turbine control system 74. This signal can notify the control system 74 that a flame holding event may be occurring in the combustor 16. The control system 74 may then be configured to evaluate the gas turbine operating conditions, surrogates for fuel pressure, and other information that may indicate flame holding (e.g. the dynamic pressure within the combustor 16 and exit temperature spreads) to determine whether the light produced by the flame indicator 66 was the result of a flame holding event or simply a false positive (e.g. due to a instantaneous flashback event). To facilitate the making of this determination, the turbine control system 74 may be programmed to compare the information gathered from a combustor 16 to a predetermined flame holding boundary. This boundary may be determined by a transfer function and may vary depending on the type of gas turbine 10 used, the operating mode of the gas turbine 10, the type of fuel being used, and numerous other factors. In the event that the predetermined flame holding boundary has been crossed, the control system 74 may then be configured to perform a corrective action in order to stop the flame holding event and prevent damage to the gas turbine 10. For example, the corrective action may comprise shutting down the gas turbine 10 or simply reducing the flow a fuel in the gas turbine 10.

In a preferred embodiment, the system of the present subject may be configured such that the offending fuel circuit (i.e. the circuit supplying fuel to the location at which the flame holding event may be occurring) can be determined. For example, each combustor 16 in a gas turbine 10 may include one or more flame indicators 66 disposed within each premixed fuel nozzle assembly 28 (FIG. 5) and one or more flame indicators 66 disposed on or adjacent to the components of the quaternary fuel system 38 (FIG. 6). The flame indicators 66 may be configured to produce light of a specific color that may vary to correspond to one of the fuel circuits within a gas turbine. Thus, in one embodiment, the flame indicators 66 disposed within the fuel nozzle assemblies 28 fueled by the PM1 fuel circuit may be configured to produce a certain colored light in the presence of a flame, such as a blue light. Similarly, the flame indicators 66 disposed within the fuel nozzle assemblies 28 fueled by the PM2 and PM3 fuel circuits may be configured to produce a different colored light, such as red and yellow, respectively. Further, the flame indicators 66 disposed on or adjacent to the components of the quaternary fuel system 38 may produce another colored light, such as green.

This configuration can allow the system of the present subject matter to effectively detect and control flame holding by discriminating both the combustor 16 in which the flame holding event may be occurring and also the offending fuel circuit. Specifically, the turbine control system 74 may be configured to analyze the signal transmitted from the detector 68 to determine the specific color of light sensed by the detector 68. Thus, when a detector 68 detects colored light corresponding to a particular fuel circuit, the turbine control system 74 may be configured to perform a corrective action directed solely to the offending fuel circuit.

It should be appreciated that the corrective action performed by the turbine control system 74 may generally comprise any action designed to eliminate a flame holding event. In one embodiment, the corrective action may include reducing the amount of fuel flowing through the offending fuel circuit. This can be accomplished by either reducing the flow of fuel through the offending fuel circuit without adjusting the amount of fuel flowing through the other circuits, thereby reducing the total amount of fuel supplied to the combustors 16, or by adjusting the percentage of fuel flow to the other fuel circuits to accommodate the reduction in fuel flowing through the offending fuel circuit. In another embodiment, the corrective action may include cutting off the supply of fuel to the offending fuel circuit. If such an action is performed, the turbine operators or the turbine control system 74 may then determine a further course of action, such as holding the fuel load until it is convenient to shutdown the gas turbine 10 or re-loading the circuit to see if the flame holding event has cleared. In a further embodiment, the corrective action may include shutting down the machine to ensure that damage to the gas turbine 10 is minimized.

Additionally, it should be appreciated that the present subject matter also encompasses a gas turbine 10 capable of detecting and controlling flashback and flame holding within a combustor 16. The gas turbine may include a compressor section 12 configured to pressurize air flowing into the gas turbine 10. A combustor section 14 may be disposed downstream from the compressor section 12 and may be configured to receive the air discharged from the compressor section 12. The combustor section 14 may comprise a plurality of combustors 16 configured to mix the pressurized air with fuel to form an air/fuel mixture and combust the air/fuel mixture. A turbine section 18 may be disposed downstream of the combustor section 14 and may be configured to receive hot gases of combustion flowing from each of the combustors 16. Additionally, the gas turbine 10 may include the system described above and illustrated herein.

It should also be appreciated that the present subject matter encompasses a method for detecting and controlling flashback and flame holding within a combustor 16 of a gas turbine 10. The method generally includes the steps of indicating the existence of flame holding in a combustor 16 by producing light of a specific color, detecting the light produced, notifying a gas turbine control system 74 of the detected light and determining whether flame holding exists within the combustor 16.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for detecting and controlling flashback and flame holding in a combustor of a gas turbine, the system comprising:

at least one flame indicator disposed in a combustor of a gas turbine, said at least one flame indicator including at least one protective layer and at least one witness layer, said at least one protective layer configured to ablate in the presence of a flame so as to reveal said at least one witness layer, said at least one witness layer configured to produce light of a specific color when exposed to a flame; and at least one detector disposed downstream from said at least one flame indicator, said at least one detector configured to detect the light produced by said at least one flame indicator.

2. The system of claim 1, wherein said at least one flame indicator comprises a plurality of protective layers and a plurality of witness layers.

3. The system of claim 1, further comprising a plurality of flame indicators disposed in said combustor, wherein the specific color of the light produced by said at least one witness layer of each of said plurality of flame indicators may vary to correspond to one of a plurality of fuel circuits within said gas turbine.

4. The system of claim 3, wherein one of said plurality of flame indicators is disposed in each of a plurality of fuel nozzle assemblies of said combustor.

5. The system of claim 1, wherein said at least one flame indicator is disposed in at least one of a fuel nozzle assembly of said combustor or is disposed on or adjacent to a component of a quaternary fuel system of said combustor.

6. The system of claim 1, further comprising a turbine control system in communication with said at least one detector, said turbine control system configured to determine whether flame holding exists within a combustor.

7. A gas turbine capable of detecting and controlling flashback and flame holding within a combustor, the gas turbine comprising:

a compressor section configured to pressurize air flowing into a gas turbine;

a combustor section disposed downstream of said compressor section and configured to receive the pressurized air discharged from said compressor section, said combustor section comprising a plurality of combustors configured to mix the pressurized air with fuel to form an air/fuel mixture and combust the air/fuel mixture;

a turbine section disposed downstream of said combustor section, said turbine section configured to receive hot gases of combustion flowing from each of said plurality of combustors;

at least one flame indicator disposed in at least one of said plurality of combustors, said at least one flame indicator including at least one protective layer and at least one witness layer, said at least one protective layer configured to ablate in the presence of a flame so as to reveal said at least one witness layer, said at least one witness layer configured to produce light of a specific color when exposed to a flame; and at least one detector disposed downstream from said at least one flame indicator, said at least one detector configured to detect the light produced by said at least one flame indicator.

8. The gas turbine of claim 7, wherein said at least one flame indicator comprises a plurality of protective layers and a plurality of witness layers.

9. The gas turbine of claim 7, further comprising a plurality of flame indicators and at least one detector disposed in each of said plurality of combustors, wherein the specific color of the light produced by said witness layer of each of said plurality of flame indicators may vary to correspond to one of a plurality of fuel circuits supplying fuel to said plurality of combustors.

10. The gas turbine of claim 9, wherein one of said plurality of flame indicators is disposed in each of a plurality of fuel nozzle assemblies of said plurality of combustors.

11. The gas turbine of claim 7, wherein said at least one flame indicator is disposed in at least one of a fuel nozzle assembly of at least one of said plurality of combustors, or disposed on or adjacent to a component of a quaternary fuel system of at least one of said plurality of combustors.

12. The gas turbine of claim 7, further comprising a turbine control system in communication with said at least one detector, said turbine control system configured to determine whether flame holding exists within said combustor section.

* * * * *